US006525637B1

(12) United States Patent
Van Gestel et al.

(10) Patent No.: US 6,525,637 B1
(45) Date of Patent: Feb. 25, 2003

(54) TRANSFORMER

(75) Inventors: Patrick H. Van Gestel, Eindhoven (NL); Patrick A. F. Claus, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 18 days.

(21) Appl. No.: 09/670,134

(22) Filed: Sep. 26, 2000

(30) Foreign Application Priority Data

Sep. 29, 1999 (EP) ..... 99203182

(51) Int. Cl.[7] ..... H01F 27/29
(52) U.S. Cl. ..... 336/192; 336/198
(58) Field of Search ..... 336/65, 107, 192, 336/198, 208, 185

(56) References Cited

U.S. PATENT DOCUMENTS 3,939,362 A * 2/1976 Grimes et al. ..... 336/107
4,596,974 A * 6/1986 Tobben et al. ..... 336/197
4,857,878 A * 8/1989 Eng, Jr. et al. ..... 336/192
5,694,105 A * 12/1997 Weiner ..... 336/198
5,760,670 A * 6/1998 Yeh et al. ..... 336/134

FOREIGN PATENT DOCUMENTS

GB 2216729 A 10/1989 ..... H01F/27/24
JP 61-29109 * 2/1986
WO WO9705632 2/1997 ..... H01F/27/30

* cited by examiner

*Primary Examiner*—Tuyen T. Nguyen
(74) *Attorney, Agent, or Firm*—Dicran Halajian

(57) ABSTRACT

A transformer includes a coil carrier having a first flange and a second flange. Primary and secondary coils are wound around the coil carrier between the first flange and the second flange. High-voltage contacts are located near the second flange and connected with the primary coil, and low-voltage contacts are located near the first flange and connected with the secondary coil. The first flange has a wall transverse to the coil carrier, and first and second sidewalls transverse to the wall so that the low-voltage contacts are surrounded on three sides by the wall and the first and second sidewalls.

20 Claims, 3 Drawing Sheets

TRANSFORMER

FIELD OF THE INVENTION

The invention relates to a transformer which comprises:

a coil carrier with a hollow coil tube which has a first flange and a second flange;

a primary coil and a secondary coil around the coil tube between the first flange and the second flange;

high-voltage contacts at the second flange in connection with the primary coil;

low-voltage contacts at the first flange in connection with the secondary coil;

a magnetic flux conductor in, laterally of, and transverse to the coil tube;

a first portion of the magnetic flux conductor which extends transversely to the coil tube being accommodated in a trough-shaped holder with ends, which holder is integral with the first flange; and the low-voltage contacts extending transversely to the coil tube and transversely to the trough-shaped holder.

BACKGROUND OF THE INVENTION

Such a transformer is known from WO 97/05632.

In the known transformer, a magnetic flux conductor is formed by an E-shaped core which is present inside and laterally of a coil tube and which cooperates with an I-shaped core which extends transversely to the coil tube and is present in a trough-shaped holder. A comparatively thick insulation layer around the primary or around the secondary coil is necessary for obtaining a safeguard against electrical breakdown between the primary and the secondary coil in accordance with a generally accepted safety standard. It is usual in these transformers to provide this comparatively thick insulation layer around the secondary coil, which is present at the low-voltage side. The secondary coil in this case consists of, for example, triple-insulated wire. This secondary coil has fewer turns than does the primary coil, so that the cost of this insulation layer can remain limited. The primary coil in this situation has a comparatively low insulation value, so that a breakdown will occur between the primary coil and the cores if an overvoltage should arise on the high-voltage contacts at the high-voltage side of the transformer. These cores, accordingly, form part of the high-voltage side in the case of any breakdown.

A disadvantage of the known transformer is that the high-voltage side is not securely separated from the low-voltage side. A breakdown from the primary coil to the cores involves the risk of breakdown from the high-voltage side to the low-voltage side because the low-voltage contacts, which belong to the low-voltage side, are present adjacent the cores, which belong to the high-voltage side. When these transformers are used in a circuit, therefore, the safety of operators handling this circuit with transformer is not guaranteed. In addition, there is a risk of damage to further electrical components in the circuit which are in connection with the low-voltage contacts because high-voltage is capable of reaching the low-voltage side of the transformer.

SUMMARY OF THE INVENTION

It is an object of the invention to provide a transformer of the kind mentioned in the opening paragraph in which the high-voltage side is separated with a high degree of security from the low-voltage side.

According to the invention, the above object is achieved by the transformer which is characterized in that the first flange has a first extension that extends away from a first side of the coil tube along the low-voltage contacts The first flange also has a second extension extending from a second side of the coil tube, where the first side is opposite the second side. The first extension is longer than the second extension. The first flange thus forms an additional electrical separation between the magnetic flux conductor and the low-voltage contacts. This forms a so-called clearance distance where the first flange constitutes a comparatively long distance for arcing through the air between the magnetic flux conductor and the low-voltage contacts. Further, a comparatively long creepage path is also formed between the magnetic flux conductor and the low-voltage contacts. The creepage path is the shortest path along which a current, a so-called creepage current, can flow along material which is present between the magnetic flux conductor and the low-voltage contacts. The creepage current flows along the surface of the material as a result of, for example, pollutants and moisture present on the material and is dependent on the type of synthetic resin of the material. Since the first flange forms a comparatively long clearance distance, no arcing through the air can take place between the magnetic flux conductor and the low-voltage contacts, given usual values of overvoltages. In addition, the lengthened flange forms a comparatively long creepage path from the magnetic flux conductor along the surface of one side of the flange, over the edge and along the surface of the other side of the flange, along the surface of the holder to the low-voltage contacts of the transformer.

In one embodiment, a wall transverse to the first flange is present at each end of the trough-shaped holder and also at the first flange. The wall extends along the low-voltage contacts. This renders it possible for the low-voltage contacts to be present close to the ends without a comparatively short creepage path from the low-voltage contacts to the magnetic flux conductor being caused thereby.

In a further embodiment, the wall, seen transversely to the first flange, extends to beyond the trough-shaped holder.

An additional embodiment of the transformer according to the invention is characterized in that the coil tube has a rectangular cross-section with an opening at each of two mutually opposed sides. Through the openings, a better thermal contact is obtained between the coils, which are wound around the coil tube, and a portion of the magnetic flux conductor present in the coil tube. This is favorable for the removal of heat generated in the coils and the portion of the magnetic flux conductor present in the coil tube.

BRIEF DESCRIPTION OF THE DRAWINGS

The transformer according to the invention will be explained in more detail below with reference to the drawings, in which.

DETAILED DESCRIPTION OF THE INVENTION

Figure 1:
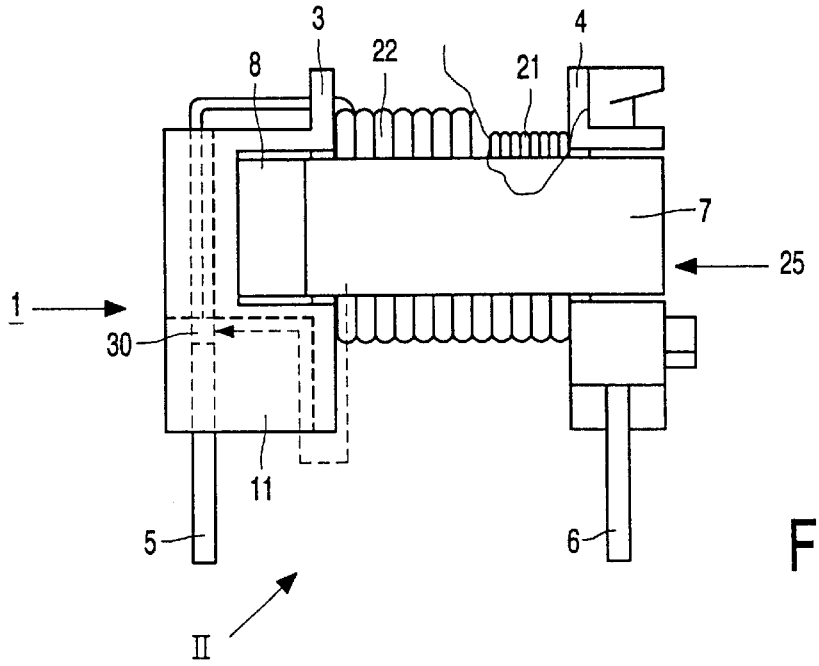
FIG. 1 shows a first embodiment of the transformer according to the invention in side elevation, partly broken away.
Figure 2:
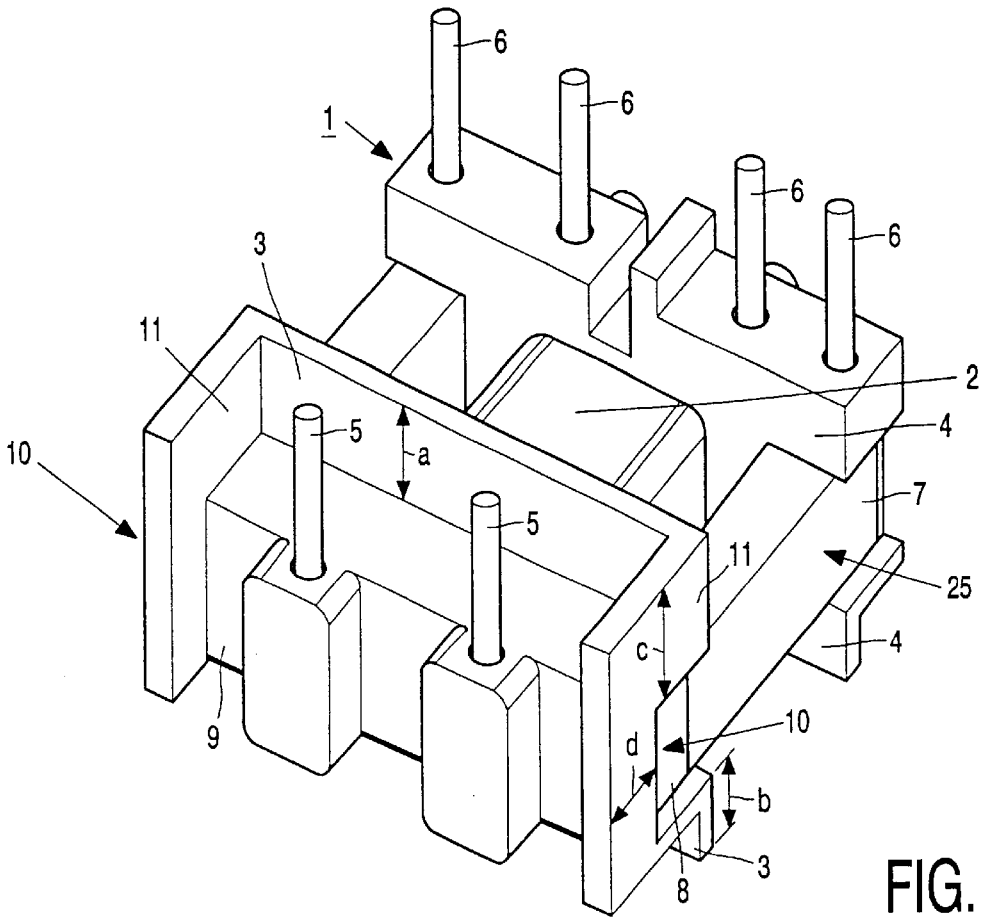
FIG. 2 shows the transformer of FIG. 1 in a perspective view along II.
Figure 3:
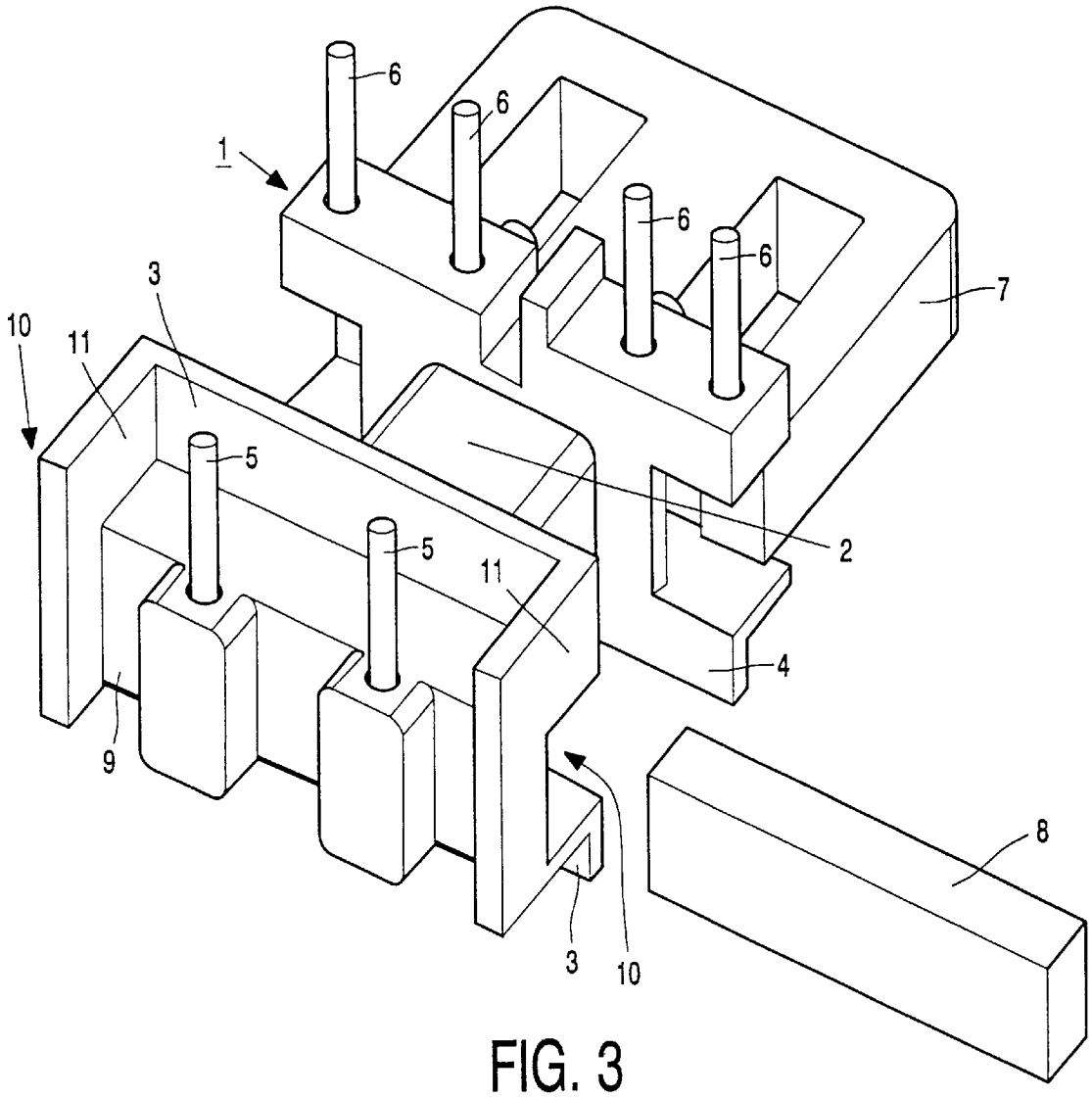
FIG. 3 shows the transformer of FIG. 2 in exploded view.

The transformer according to the invention shown in FIG. 1 and FIG. 2 comprises a coil carrier 1 which has a hollow coil tube 2 with a first flange 3 and a second flange 4. As is visible in FIG. 1, a primary coil 21 and a secondary coil 22 are present around the coil tube 2. In the Figure, a portion of the secondary coil 22 has been left out so as to show the primary coil 21 which is situated below the secondary coil 22. The primary and secondary coils 21 and 22 have been left out in FIGS. 2, 3, 4 and 5 so as to render the coil tube 2 visible. Low-voltage contacts 5 are present adjacent the first flange 3, and high-voltage contacts 6 are present adjacent the second flange 4. In this embodiment as shown in FIGS. 2 and 3, a magnetic flux conductor 25 formed by an E-shaped core 7 is present in and at lateral sides of the coil tube 2, cooperating with an I-shaped core 8. The I-shaped core 8 is transverse to the coil tube 2 in a trough-shaped holder 9 with open ends 10, where the holder 9 is integral with the first flange 3. In this embodiment, the low-voltage contacts 5 extend transversely to the coil tube 2 and transversely to the I-shaped core 8 and are formed by pins. As is visible in FIGS. 2 and 3, the first flange 3 extends to form first and second extensions. The first extension extends at a first side of the coil tube 2 where the low-voltage contacts 5 are present. The first extension is along the low-voltage contacts 5 and extends farther away from the coil tube 2 than the second extension at an opposite or second side of the coil tube 2. The first extension is indicated in FIG. 2 as the distance a on the first flange 3 at the first side of the coil tube 2, where the low-voltage contacts 5 are present, which distance a is greater than a distance b of the second extension at the opposite or second side of the coil tube 2. The first flange 3 in this manner forms an additional electrical separation between the cooperating cores 7 and 8 and the low-voltage contacts 5. The separation creates a comparatively long creepage path, indicated with an arrow in broken lines in FIG. 1 and extending from the cooperating cores 7 and 8 along the surface at one side of the flange, over the edge and along the surface at the other side of the flange 3, along the surface of the holder 9 to the low-voltage contacts 5 of the transformer.

Furthermore, a comparatively long creepage path is also realized in this manner from a fastening point 30 (of the secondary coil 27 to the low-voltage contacts 5, where the triple insulation is usually subject to degradation,) to the primary coil at the high-voltage side, which benefits the high-security separation between the high-voltage side and the low-voltage side. It is further apparent in FIGS. 2 and 3 that a wall 11 transverse to the first flange 3 is present at each end of the trough-shaped holder 9 and also at the first flange 3. This wall extends along the low-voltage contacts 5, which is indicated as a distance c in FIG. 2. In addition, the wall 11 extends, in a transverse direction to the first flange 3, to go beyond the trough-shaped holder 9, which is indicated as a distance d in FIG. 2. Thus, additional electrical separations have been created between the cooperating cores 7 and 8 on the one hand and the low-voltage contacts 5 on the other hand, so that the low-voltage contacts 5 may be present near the ends without creating a comparatively short creepage path from the low-voltage contacts 5 to the magnetic flux conductor 25.

It is noted that this invention offers a possibility of separating the high-voltage side with high security from the low-voltage side also in miniaturized transformers, such as switch mode transformers.

It is also noted that the lengthened flange offers an additional protection against damage to the magnetic flux conductor if the transformer should inadvertently be dropped.

Figure 4:
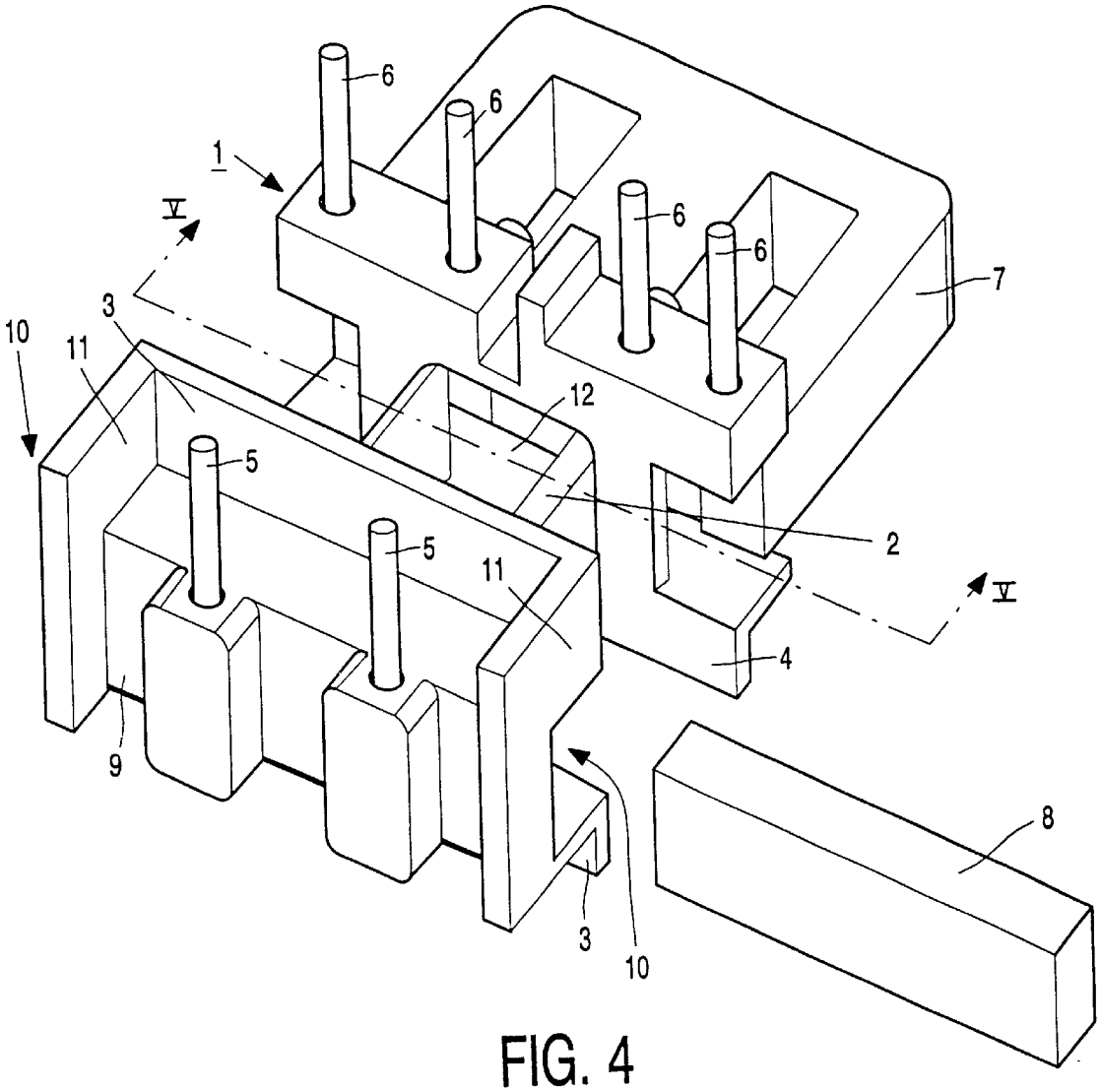
FIG. 4 shows a second embodiment of the transformer according to the invention in exploded view.
Figure 5:
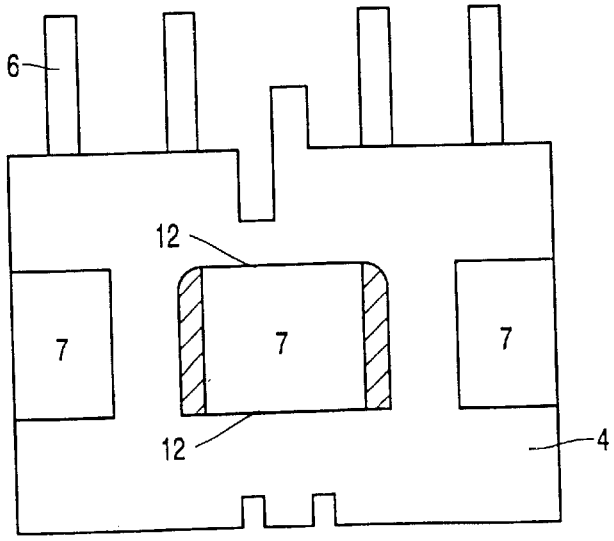
FIG. 5 is a cross-section taken on the line V—V in FIG. 4.

FIGS. 4 and 5 show a second embodiment of the transformer according to the invention in which the coil tube 2 has a rectangular cross-section with an opening 12 at each of two mutually opposed sides. The second embodiment of the transformer according to the invention further comprises substantially the same components as the first embodiment. Corresponding components of the first and second embodiments have been given the same reference numerals in FIGS. 4 and 5. A better thermal contact is achieved through the openings 12 between the coils 21, 22 (that are wound around the coil tube 2 visible in FIG. 1) and the portion of the magnetic flux conductor 25 present inside the coil tube. This is favorable for the removal of heat generated in the coils 21 and 22 to the E-shaped core 7. The transformer will remain comparatively cool owing to the comparatively large cooling surface area of the core 7, which benefits the power capacity of the transformer.

What is claimed is:

1. A transformer comprising:

a coil carrier with a hollow coil tube which has a first flange and a second flange;

a primary coil and a secondary coil around the coil tube between the first flange and the second flange;

high-voltage contacts at the second flange in connection with the primary coil; and low-voltage contacts at the first flange in connection with the secondary coil;

wherein the first flange has a wall and sidewalls, said wall being transverse to the first flange, wherein said low-voltage contacts are between said sidewalls.

2. A transformer as claimed in claim 1, wherein the wall, seen transversely to the first flange, extends to beyond the trough-shaped holder.

3. A transformer as claimed in claim 1, the coil tube has a rectangular cross-section with an opening at each of two mutually opposed sides.

4. A transformer as claimed in claim 1, wherein said first flange extends along the low-voltage contacts by a first distance in a first direction, and extends on a side opposite the low-voltage contacts by a second distance in a second direction, said first distance being greater than said second distance.

5. A transformer comprising:

a coil carrier having a first flange and a second flange;

a primary coil and a secondary coil wound around the coil carrier between the first flange and the second flange;

high-voltage contacts located near the second flange and connected with the primary coil; and low-voltage contacts extending from a base of the first flange and connected with the secondary coil;

wherein said first flange has a wall transverse to said coil carrier, and first and second sidewalls transverse to said wall so that said low-voltage contacts are surrounded on four sides by said wall, said first and second sidewalls, and said base.

6. The transformer of claim 5, wherein said coil carrier has a hollow coil tube, said primary coil and said secondary coil being wound around said hollow coil tube between the first flange and the second flange.

7. The transformer of claim 5, wherein said first flange extends by a first distance in a first direction and by a second distance in a second direction, said first distance being greater than said second distance.

8. The transformer of claim 7, wherein said first distance is on a side of said low-voltage contacts.

9. The transformer of claim 8, wherein said second distance is on a side opposite to said first distance.

10. The transformer of claim 7, wherein said second distance is on a side opposite to said low-voltage contacts.

11. A transformer comprising:

a coil carrier having a first flange and a second flange;

a primary coil and a secondary coil wound around the coil carrier between the first flange and the second flange;

high-voltage contacts located near the second flange and connected with the primary coil; and low-voltage contacts located near the first flange and connected with the secondary coil;

wherein said first flange has a wall transverse to said coil carrier, and first and second sidewalls transverse to said wall so that said low-voltage contacts are between said first and second sidewalls.

12. The transformer of claim 11, wherein said coil carrier has a hollow coil tube, said primary coil and said secondary coil being wound around said hollow coil tube between the first flange and the second flange.

13. The transformer of claim 11, wherein said first flange extends along the low-voltage contacts by a first distance in a first direction and by a second distance in a second direction, said first distance being greater than said second distance.

14. The transformer of claim 13, wherein said second distance is on a side opposite to said low-voltage contacts.

15. The transformer of claim 13, wherein said first distance is on a side of said low-voltage contacts.

16. The transformer of claim 15, wherein said second distance is on a side opposite to said first distance.

17. A transformer comprising:

a coil carrier having a first flange and a second flange;

a primary coil and a secondary coil wound around said coil carrier between said first flange and said second flange;

at least one high-voltage contact located near said second flange and connected with said primary coil; and at least one low-voltage contact located near said first flange and connected with said secondary coil;

wherein said first flange has a wall and sidewalls, said wall being transverse to said coil carrier and said at least one low-voltage contact being between said sidewalls.

18. The transformer of claim 17, wherein said coil carrier has a hollow coil tube, said primary coil and said secondary coil being wound around said hollow coil tube between the first flange and the second flange.

19. The transformer of claim 17, wherein said first flange extends along said at least one low-voltage contact by a first distance in a first direction and by a second distance in a second direction, said first distance being greater than said second distance.

20. The transformer of claim 19, wherein said first distance is on a side of said at least one low-voltage contact, and said second distance is on a side opposite to said at least one low-voltage contact.

* * * * *